US010386881B2

(12) United States Patent
Yang et al.

(10) Patent No.: US 10,386,881 B2
(45) Date of Patent: Aug. 20, 2019

(54) POWER SUPPLY CIRCUIT AND A METHOD OF CONTROLLING THE SAME

(71) Applicants: Semiconductor Manufacturing International (Shanghai) Corporation, Shanghai (CN); Semiconductor Manufacturing International (Beijing) Corporation, Beijing (CN)

(72) Inventors: Chia Chi Yang, Shanghai (CN); Chen Yi Huang, Shanghai (CN); Zhi Bing Deng, Shanghai (CN); Cheng Tai Huang, Shanghai (CN); Wen Jun Weng, Shanghai (CN)

(73) Assignees: SEMICONDUCTOR MANUFACTURING INTERNATIONAL (SHANGHAI) CORPORATION (CN); SEMICONDUCTOR MANUFACTURING INTERNATIONAL (BEIJING) CORPORATION (CN)

( * ) Notice: Subject to any disclaimer, the term of this patent is extended or adjusted under 35 U.S.C. 154(b) by 0 days.

(21) Appl. No.: 16/021,746

(22) Filed: Jun. 28, 2018

(65) Prior Publication Data

US 2019/0004557 A1 Jan. 3, 2019

(30) Foreign Application Priority Data

Jun. 29, 2017 (CN) ..... 2017 1 0514058

(51) Int. Cl.
*G05F 3/24* (2006.01)
*G05F 1/575* (2006.01)

(52) U.S. Cl.
CPC ..... *G05F 3/242* (2013.01); *G05F 1/575* (2013.01); *G05F 3/247* (2013.01)

(58) Field of Classification Search
CPC ..... G05F 1/575; G05F 3/247
USPC ..... 323/241, 243, 271, 272, 313, 314, 281
See application file for complete search history.

(56) References Cited

U.S. PATENT DOCUMENTS 7,579,822 B1 8/2009 Sutardja et al.
7,619,402 B1 * 11/2009 Kwong ..... G05F 1/575 323/297
8,026,710 B2 * 9/2011 Sutardja ..... G05F 3/30 323/313
2003/0052661 A1 * 3/2003 Tachimori ..... G05F 3/242 323/313

(Continued)

*Primary Examiner* — Gary A Nash
(74) *Attorney, Agent, or Firm* — Innovation Counsel LLP

(57) ABSTRACT

A power supply circuit, its generating and control methods are presented, relating to smart wearable devices. The power supply circuit comprises a Bandgap voltage reference, a real-time detection and control circuit, and a substitute voltage source. The real-time detection and control circuit is connected to the Bandgap voltage reference and the substitute voltage source, and adjusts an output voltage of the substitute voltage source to match an output voltage of the Bandgap voltage reference. After these output voltages are equal, the output voltage of the power supply circuit is provided by the substitute voltage source, and the Bandgap voltage reference can be disconnected from the circuit. This circuit can lower the power consumption of the Bandgap voltage reference without affecting the stability of the voltage output.

20 Claims, 10 Drawing Sheets

(56) References Cited

U.S. PATENT DOCUMENTS

2013/0241522 A1* 9/2013 Youssefi ..... G05F 3/30
323/313
2014/0266140 A1* 9/2014 Iriarte ..... G05F 3/242
323/313

* cited by examiner

POWER SUPPLY CIRCUIT AND A METHOD OF CONTROLLING THE SAME

CROSS-REFERENCE TO RELATED APPLICATION

This application claims priority to and benefit of Chinese Patent Application No. 201710514058.1 filed on Jun. 29, 2017, which is incorporated herein by reference in its entirety.

BACKGROUND

(a) Field of the Invention

This inventive concept relates to smart wearable technology and, more specifically to a power supply circuit and its generating and control methods.

(b) Description of the Related Art

Low power consumption and long operation time are two increasingly important specs for a smart wearable device. Bandgap voltage reference provides a stable voltage supply, and therefore could be an ideal power supply for wearable devices if its power consumption can be lowered to a suitable range.

In conventional Bandgap circuits, low power consumption and robust noise tolerance are two competing interests, and achieving one usually is at the expense of the other. According to their power consumption and noise tolerance capability, Bandgap circuits are commonly categorized into three major types: 10 uA circuit, 5 uA circuit and 1 uA circuit. A 10 uA Bandgap circuit has robust noise tolerance and is suitable for all devices, a 5 uA Bandgap circuit has intermediate noise tolerance and therefore may not be suitable for high speed devices such as CPU and Radio Frequency (RF) devices, and a 1 uA Bandgap circuit has only basic noise tolerance and is suitable for low speed devices only.

Conventionally, 1 uA is considered the lower limit of a Bandgap circuit's power consumption. However, even a 1 uA circuit consumes too much power by the standard of a wearable device. The requirement on extremely low power consumption severely limits the application of Bandgap voltage reference in wearable devices.

SUMMARY

This inventive concept, based on the investigation on the limitations of conventional methods, proposes a solution that remedies at least one limitation in conventional methods.

This inventive concept first presents a power supply circuit, comprising:

a Bandgap voltage reference;

a real-time detection and control circuit; and a substitute voltage source, wherein the real-time detection and control circuit is connected to the substitute voltage source and the Bandgap voltage reference, and adjusts an output voltage of the substitute voltage source based on an output voltage of the Bandgap voltage reference, when these two output voltages are equal, the substitute voltage source replaces the Bandgap voltage reference to provide an output voltage of the power supply circuit.

Additionally, in the aforementioned circuit, adjusting an output voltage of the substitute voltage source based on an output voltage of the Bandgap voltage reference may comprise:

connecting an output node of the Bandgap voltage reference to an output node of the substitute voltage source;

adjusting the output voltage of the substitute voltage source based on a current between the output node of the substitute voltage source and the output node of the Bandgap voltage reference, when the current between these two output nodes is zero, the output node of the Bandgap voltage reference is disconnected from the output node of the substitute voltage source.

Additionally, the aforementioned circuit may further comprise:

the real-time detection and control circuit monitoring the output voltage of the substitute voltage source when the substitute voltage source provides the output voltage of the power supply circuit; and increasing the output voltage of the substitute voltage source if it is lower than a bottom threshold, and lowering the output voltage of the substitute voltage source if it is higher than a top threshold.

Additionally, in the aforementioned circuit, the substitute voltage source may comprise:

a P-type Metal-Oxide-Semiconductor (PMOS) transistor;

an N-type Metal-Oxide-Semiconductor (NMOS) transistor;

a first resistance;

a second resistance; and a capacitance, wherein a gate of the PMOS transistor is connected to a PMOS control node of the real-time detection and control circuit, a source of the PMOS transistor is connected to an input high voltage, and a drain of the PMOS transistor is connected to a first node of the first resistance, wherein a gate of the NMOS transistor is connected to a NMOS control node of the real-time detection and control circuit, a source of the NMOS transistor is connected to the ground, and a drain of the NMOS transistor is connected to a second node of the second resistance, wherein a second node of the first resistance is connected to a first node of the second resistance, at least one of the first resistance and the second resistance is adjustable, and a control node of the resistance that is adjustable is connected to a resistance control node of the real-time detection and control circuit, wherein a first node of the capacitance is connected to the ground, and a second node of the capacitance is connected to the first node of the second resistance, and wherein either the second node of the first resistance or the first node of the second resistance, or both, is the output node of the substitute voltage source.

Additionally, in the aforementioned circuit, adjusting the output voltage of the substitute voltage source based on a current between the output node of the substitute voltage source and the output node of the Bandgap voltage reference may comprise:

the real-time detection and control circuit adjusting the adjustable resistance, so that a current between the output node of the substitute voltage source and an output node of the Bandgap voltage reference is zero, wherein the output node of the Bandgap voltage reference is connected to the output node of the substitute voltage source.

Additionally, in the aforementioned circuit, when the real-time detection and control circuit adjusting the resistance that is adjustable, the real-time detection and control circuit may provide a low voltage to the gate of the PMOS transistor, and a high voltage to the gate of the NMOS transistor.

Additionally, the aforementioned circuit may further comprise:

the real-time detection and control circuit monitoring the output voltage of the substitute voltage source when the substitute voltage source provides the output voltage of the power supply circuit; and providing a low voltage to the gate of the PMOS transistor, and a high voltage to the gate of the NMOS transistor when the output voltage of the substitute voltage source is lower than a bottom threshold, and providing the high voltage to the gate of the PMOS transistor, and the low voltage to the gate of the NMOS transistor when the output voltage of the substitute voltage source is higher than a top threshold.

Additionally, the aforementioned circuit may further comprise:

the real-time detection and control circuit, through a predetermined pulse signal, providing control voltages to the gate of the PMOS transistor and the gate of the NMOS transistor when the substitute voltage source provides the output voltage of the power supply circuit, wherein the control voltage provided to the gate of the PMOS transistor is opposite to the control voltage provided to the gate of the NMOS transistor.

Additionally, the aforementioned circuit may further comprise:

after the substitute voltage source had been providing the output voltage of the power supply circuit for longer than a predetermined period of time, the real-time detection and control circuit adjusting the output voltage of the substitute voltage source to match the output voltage of the Bandgap voltage reference.

This inventive concept further presents a method for forming a power supply circuit, comprising:

connecting a Bandgap voltage reference to a real-time detection and control circuit;

connecting a substitute voltage source to the real-time detection and control circuit, wherein the real-time detection and control circuit adjusts an output voltage of the substitute voltage source based on an output voltage of the Bandgap voltage reference, when these two output voltages are equal, the substitute voltage source provides an output voltage of the power supply circuit.

Additionally, the aforementioned method may further comprise:

forming the substitute voltage source, comprising:

connecting a source of a PMOS transistor to an input high voltage;

connecting a drain of the PMOS transistor to a first node of a first resistance;

connecting a source of a NMOS transistor to the ground;

connecting a drain of the NMOS transistor to a second node of a second resistance;

connecting a second node of the first resistance to a first node of the second resistance, wherein at least one of the first resistance and the second resistance is adjustable, and a control node of the resistance that is adjustable is connected to a resistance control node of the real-time detection and control circuit; and connecting a first node of a capacitance to the ground, and a second node of the capacitance to the first node of the second resistance.

Additionally, the aforementioned method may further comprise:

connecting a gate of the PMOS transistor to a PMOS control node of the real-time detection and control circuit; and connecting a gate of the NMOS transistor to a NMOS control node of the real-time detection and control circuit.

Additionally, the aforementioned method may further comprise one of the following two procedures:

connecting the gate of the PMOS transistor to a pulse control node of the real-time detection and control circuit; and connecting the gate of the NMOS transistor, through an inverter, to the pulse control node of the real-time detection and control circuit; or connecting the gate of the NMOS transistor to a pulse control node of the real-time detection and control circuit; and connecting the gate of the PMOS transistor, through an inverter, to the pulse control node of the real-time detection and control circuit.

This inventive concept further presents a control method for a power supply circuit, comprising:

adjusting an output voltage of a substitute voltage source based on an output voltage of a Bandgap voltage reference, when these two output voltages are equal, the substitute voltage source provides an output voltage of the power supply circuit.

Additionally, in the aforementioned method, adjusting an output voltage of a substitute voltage source based on an output voltage of a Bandgap voltage reference may comprise:

connecting an output node of the Bandgap voltage reference to an output node of the substitute voltage source; and adjusting the output voltage of the substitute voltage source based on a current between the output node of the Bandgap voltage reference and the output node of the substitute voltage source, when the current between these two output nodes is zero, the output node of the Bandgap voltage reference is disconnected from the output node of the substitute voltage source.

Additionally, the aforementioned method may further comprise:

monitoring the output voltage of the substitute voltage source when the substitute voltage source provides the output voltage of the power supply circuit; and increasing the output voltage of the substitute voltage source if it is lower than a bottom threshold, and decreasing the output voltage of the substitute voltage source if it is higher than a top threshold.

Additionally, in the aforementioned method, adjusting the output voltage of the substitute voltage source based on a current between the output node of the Bandgap voltage reference and the output node of the substitute voltage source may comprise:

providing a low voltage to a gate of a PMOS transistor in the substitute voltage source, and providing a high voltage to a gate of a NMOS transistor in the substitute voltage source;

adjusting a resistance in the substitute voltage source until the current between the output node of the Bandgap voltage reference and the output node of the substitute voltage source is zero, wherein the output node of the Bandgap voltage reference is connected to the output node of the substitute voltage source, wherein the substitute voltage source comprises:

the PMOS transistor;

the NMOS transistor;

a first resistance;

a second resistance; and a capacitance, wherein a source of the PMOS transistor is connected to an input high voltage, a drain of the PMOS transistor is connected to a first node of the first resistance, a source of the NMOS transistor is connected to the ground, a drain of the NMOS transistor is connected to a second node of the second resistance, a second node of the first resistance is connected to a first node of the second resistance, wherein at least one of the first resistance and the second resistance is adjustable, a first node of the capacitance is connected to the ground, and a second node of the capacitance is connected to the first node of the second resistance, and either the second node of the first resistance or the first node of the second resistance, or both, is the output node of the substitute voltage source.

Additionally, the aforementioned method may further comprise:

when the output voltage of the substitute voltage source is lower than a bottom threshold, providing the low voltage to the gate of the PMOS transistor, and providing the high voltage to the gate of the NMOS transistor; and when the output voltage of the substitute voltage source is higher than a top threshold, providing the high voltage to the gate of the PMOS transistor, and providing the low voltage to the gate of the NMOS transistor.

Additionally, the aforementioned method may further comprise:

providing control voltages to the gate of the PMOS transistor and the gate of the NMOS transistor through a predetermined pulse signal when the substitute voltage source provides the output voltage of the power supply circuit, wherein the control voltage provided to the gate of the PMOS transistor is opposite to the control voltage provided to the gate of the NMOS transistor.

Additionally, the aforementioned method may further comprise:

after the substitute voltage source has been providing the output voltage of the power supply circuit for longer than a predetermined period of time, adjusting the output voltage of the substitute voltage source to match the output voltage of the Bandgap voltage reference.

BRIEF DESCRIPTION OF THE DRAWINGS

The accompanying drawings, which are incorporated herein and constitute a part of the specification, illustrate different embodiments of the inventive concept and, together with the detailed description, serve to describe more clearly the inventive concept.

DETAILED DESCRIPTION OF THE EMBODIMENTS

Figure 1A:
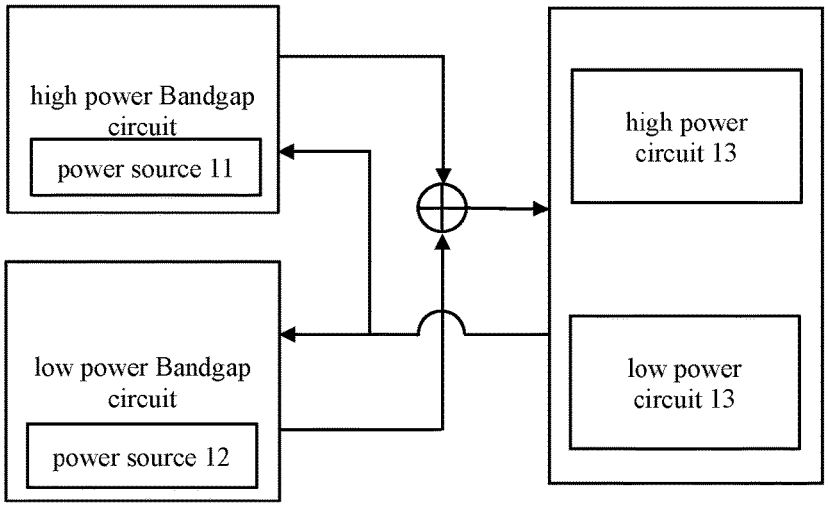
FIG. 1A shows a diagram illustrating a conventional circuit that uses a Bandgap voltage reference as a power supply.

Example embodiments of the inventive concept are described with reference to the accompanying drawings. As those skilled in the art would realize, the described embodiments may be modified in various ways without departing from the spirit or scope of the inventive concept. Embodiments may be practiced without some or all of these specified details. Well known process steps and/or structures may not be described in detail, in the interest of clarity.

The drawings and descriptions are illustrative and not restrictive. Like reference numerals may designate like (e.g., analogous or identical) elements in the specification. To the extent possible, any repetitive description will be minimized.

Relative sizes and thicknesses of elements shown in the drawings are chosen to facilitate description and understanding, without limiting the inventive concept. In the drawings, the thicknesses of some layers, films, panels, regions, etc., may be exaggerated for clarity.

Embodiments in the figures may represent idealized illustrations. Variations from the shapes illustrated may be possible, for example due to manufacturing techniques and/or tolerances. Thus, the example embodiments shall not be construed as limited to the shapes or regions illustrated herein but are to include deviations in the shapes. For example, an etched region illustrated as a rectangle may have rounded or curved features. The shapes and regions illustrated in the figures are illustrative and shall not limit the scope of the embodiments.

Although the terms "first," "second," etc. may be used herein to describe various elements, these elements shall not be limited by these terms. These terms may be used to distinguish one element from another element. Thus, a first element discussed below may be termed a second element without departing from the teachings of the present inventive concept. The description of an element as a "first" element may not require or imply the presence of a second element or other elements. The terms "first," "second," etc. may also be used herein to differentiate different categories or sets of elements. For conciseness, the terms "first,"

"second," etc. may represent "first-category (or first-set)," "second-category (or second-set)," etc., respectively.

If a first element (such as a layer, film, region, or substrate) is referred to as being "on," "neighboring," "connected to," or "coupled with" a second element, then the first element can be directly on, directly neighboring, directly connected to or directly coupled with the second element, or an intervening element may also be present between the first element and the second element. If a first element is referred to as being "directly on," "directly neighboring," "directly connected to," or "directly coupled with" a second element, then no intended intervening element (except environmental elements such as air) may also be present between the first element and the second element.

Spatially relative terms, such as "beneath," "below," "lower," "above," "upper," and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientation), and the spatially relative descriptors used herein shall be interpreted accordingly.

The terminology used herein is for the purpose of describing particular embodiments and is not intended to limit the inventive concept. As used herein, singular forms, "a," "an," and "the" may indicate plural forms as well, unless the context clearly indicates otherwise. The terms "includes" and/or "including," when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as what is commonly understood by one of ordinary skill in the art related to this field. Terms, such as those defined in commonly used dictionaries, shall be interpreted as having meanings that are consistent with their meanings in the context of the relevant art and shall not be interpreted in an idealized or overly formal sense unless expressly so defined herein.

The term "connect" may mean "electrically connect." The term "insulate" may mean "electrically insulate."

Unless explicitly described to the contrary, the word "comprise" and variations such as "comprises," "comprising," "include," or "including" may imply the inclusion of stated elements but not the exclusion of other elements.

Various embodiments, including methods and techniques, are described in this disclosure. Embodiments of the inventive concept may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the inventive concept may also cover apparatuses for practicing embodiments of the inventive concept. Such apparatus may include circuits, dedicated and/or programmable, to carry out operations pertaining to embodiments of the inventive concept. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the inventive concept.

Figure 1B:
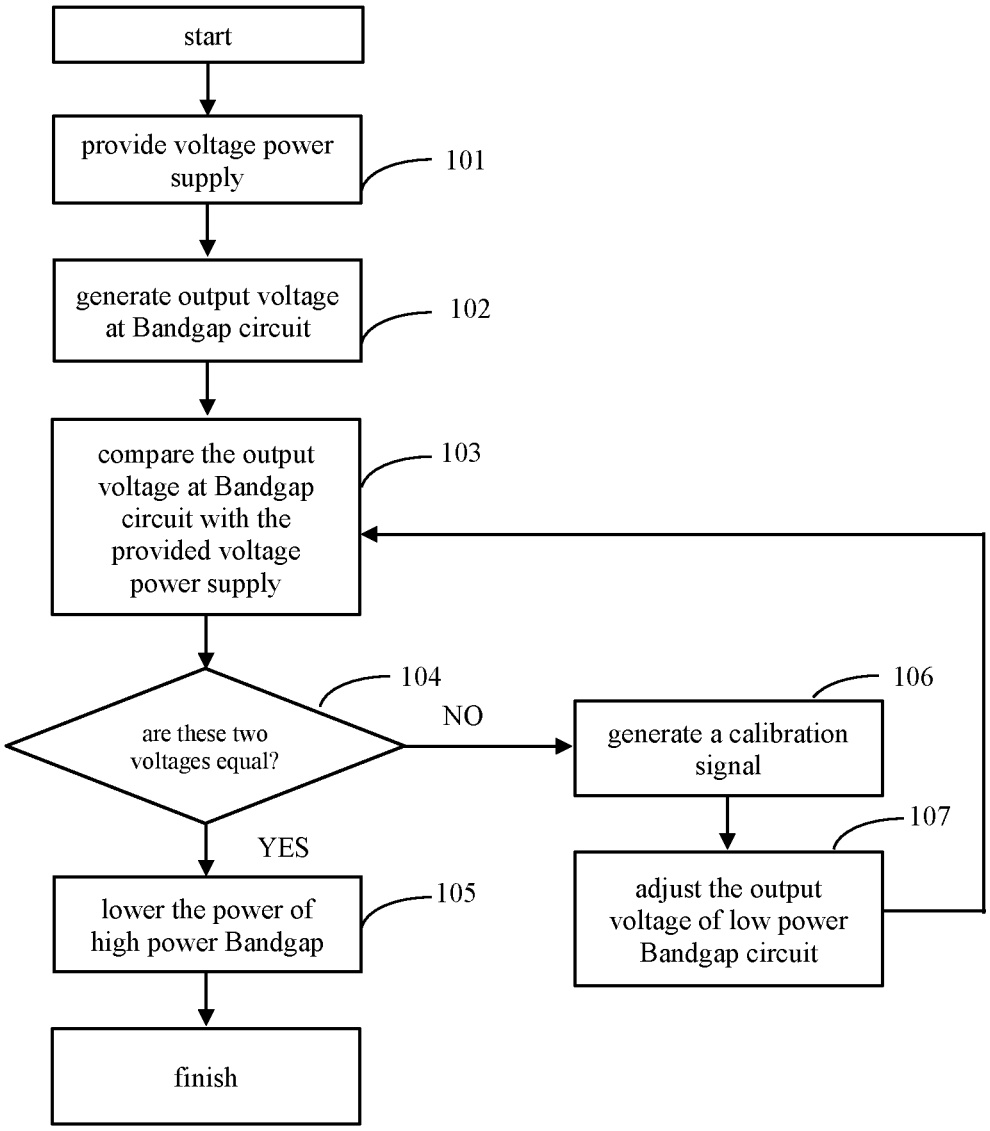
FIG. 1B shows a flowchart illustrating a conventional circuit that uses a Bandgap voltage reference as a power supply.
Figure 1C:
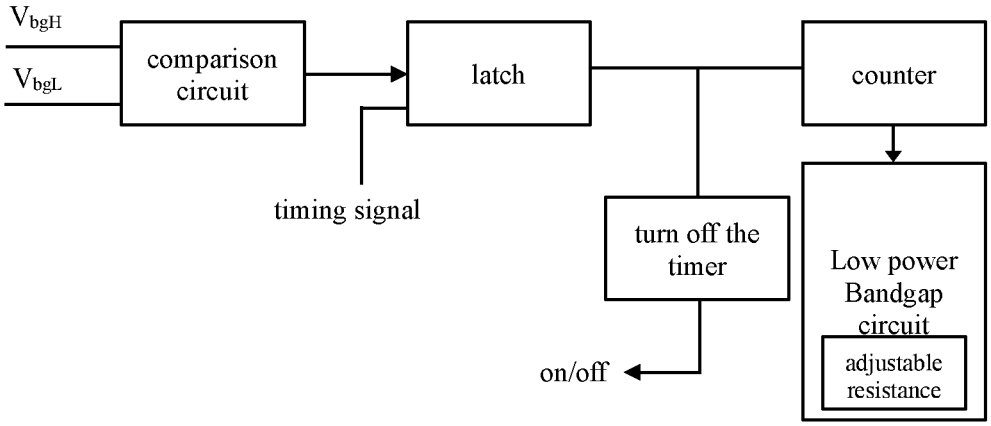
FIG. 1C shows a circuit block diagram illustrating a conventional circuit that uses a Bandgap voltage reference as a power supply.
Figure 1D:
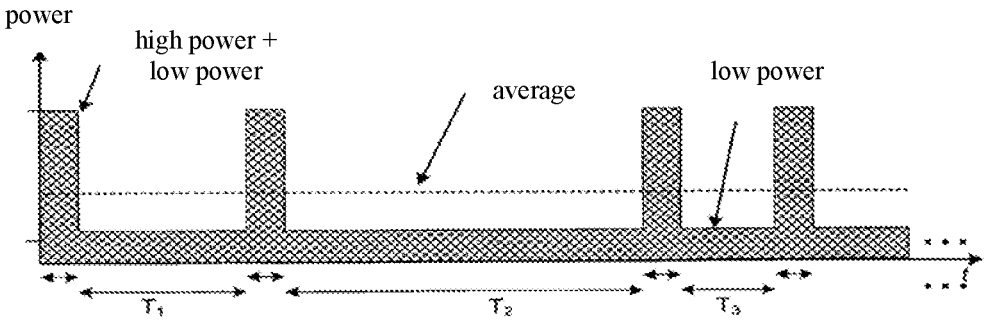
FIG. 1D shows the power consumption of a conventional circuit that uses a Bandgap voltage reference as a power supply.

FIGS. 1A, 1B, 1C, and 1D illustrate conventional Bandgap circuits and their power consumption. As shown in these drawings, in order to lower the power consumption, a conventional Bandgap circuit may include two Bandgap voltage references: a high power Bandgap voltage reference and a low power Bandgap voltage reference. This conventional configuration is described in, for example, U.S. Pat. No. 7,579,822. As shown in FIG. 1B, a conventional Bandgap circuit may only use low power Bandgap voltage reference when the power demand is low, and activate high power Bandgap voltage reference when the power demand increases. As shown in FIG. 1D, the high power Bandgap voltage reference typically has a current of about 5 uA, and its low power counterpart typically has a current of about 1 uA, therefore, by choosing a proper Bandgap voltage reference based on power demand, the overall power consumption of the Bandgap circuit can be lowered.

Figure 2:
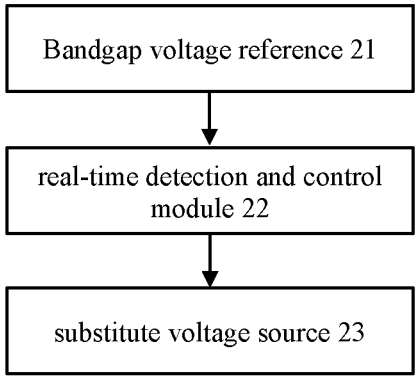
FIG. 2 shows a diagram illustrating a power supply circuit in accordance with one embodiment of this inventive concept.

FIG. 2 shows a diagram illustrating a power supply circuit in accordance with one embodiment of this inventive concept. As shown in FIG. 2, in this power supply circuit, a real-time detection and control circuit 22 is connected to a Bandgap voltage reference 21 and a substitute voltage source 23. The real-time detection and control circuit 22 may adjust an output voltage of the substitute voltage source 23 (e.g., by adjusting a circuit parameter such as a resistance in the substitute voltage source) to match an output voltage of the Bandgap voltage reference 21. When these two output voltages are equal, an output voltage of the power supply circuit may be provided by the substitute voltage source 23, and the Bandgap voltage reference 21 may be disconnected from the circuit.

In this power supply circuit, the output voltage of the substitute voltage source is first adjusted to match the output voltage of the Bandgap voltage reference, then the substitute voltage source may replace the Bandgap voltage reference to provide the output voltage of the power supply circuit, and the Bandgap voltage reference may be disconnected. Thus the power consumption of the Bandgap voltage reference may be lowered without affecting the stability of the power supply circuit's output voltage.

In one embodiment, the real-time detection and control circuit may measure the voltage difference between an output node of the Bandgap voltage reference and an output node of the substitute voltage source by measuring the current between these two output nodes. A non-zero current means there exists voltage difference between these two output nodes, and the real-time detection and control circuit 22 may adjust the substitute voltage source (e.g., by adjusting a resistance in the substitute voltage source) until the current becomes zero, which indicates that the voltages on these two output nodes are equal. Then the substitute voltage source may replace the Bandgap voltage reference to provide the output voltage of the power supply circuit, and the Bandgap voltage reference may be disconnected from the circuit.

In this power supply circuit, by measuring the current between the output node of the substitute voltage source and the output node of the Bandgap voltage reference, the voltage difference between these two output nodes may be accurately measured, that ensures the substitute voltage source can provide an output voltage closely matches the output voltage of the Bandgap voltage reference. Therefore this circuit can provide a stable and accurate voltage supply.

In one embodiment, the real-time detection and control circuit may monitor and stabilize of the output voltage of the substitute voltage source. For example, the real-time detection and control circuit may set a bottom threshold and a top threshold, and increase or decrease the output voltage of the substitute voltage source if it is less than the bottom threshold or higher than the top threshold. In one embodiment, the top threshold may be 1.2V, and the bottom threshold may be 94% of the top threshold (i.e., around 1.13V).

This power supply circuit can monitor and, if necessary, adjust the output voltage the substitute voltage source, and thus ensure a stable output voltage supply to external devices.

Figure 3:
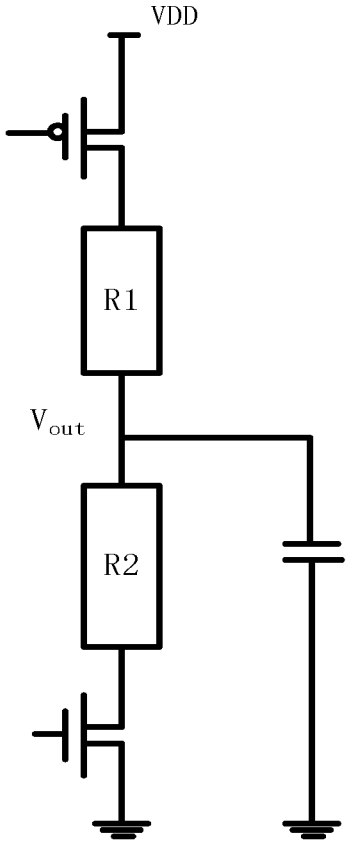
FIG. 3 shows a diagram illustrating a substitute voltage source in accordance with one embodiment of this inventive concept.

FIG. 3 shows a diagram illustrating a substitute voltage source in accordance with one embodiment of this inventive concept. As shown in FIG. 3, the substitute voltage source comprises a PMOS transistor, a NMOS transistor, a first resistance $R_1$, a second resistance $R_2$, and a capacitance. An output node of the substitute voltage source is located between the first resistance $R_1$ and the second resistance $R_2$, and the voltage at this output node is its output voltage $V_{out}$. The first resistance $R_1$ is connected to a high voltage $V_{dd}$ through the PMOS transistor, and the second resistance $R_2$ is connected to the ground through the NMOS transistor. The output node is connected to the ground through the capacitance. At least one of the first resistance $R_1$ and the second resistance $R_2$ is adjustable. The output voltage $V_{out}$ is determined by:

$$V_{out}=R_2*V_{dd}/(R_1+R_2)$$

and, by adjusting the resistance that is adjustable ($R_1$, $R_2$, or both), $V_{out}$ can be adjusted to match the output voltage of the Bandgap voltage reference. $R_1$ and $R_2$ in FIG. 3 are not limited to resistances, in one embodiment, they may be any circuit block with voltage dividing capability.

Figure 4:
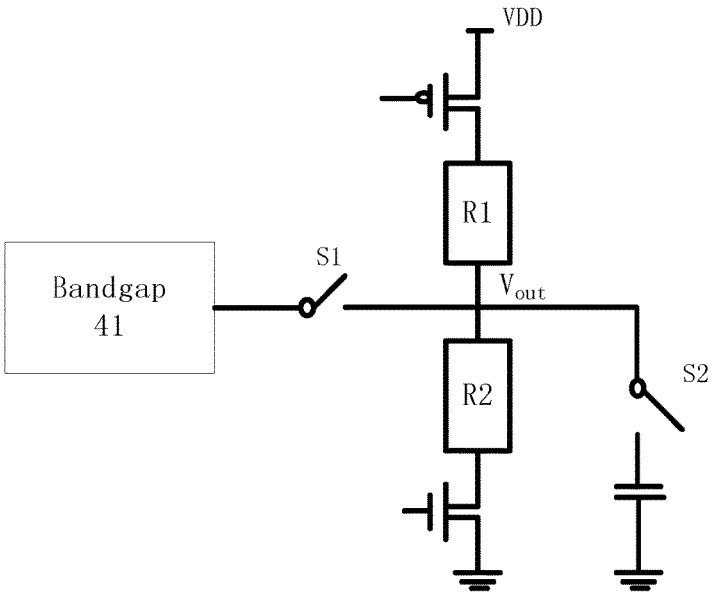
FIG. 4 shows a diagram illustrating a power supply circuit in accordance with a second embodiment of this inventive concept.

FIG. 4 shows a diagram illustrating a power supply circuit in accordance with a second embodiment of this inventive concept. Referring to FIG. 4, when matching $V_{out}$ with the output voltage of Bandgap voltage reference, a first switch $S_1$ is closed and a second switch $S_2$ is open. A gate of the PMOS transistor is connected to a low voltage, and a gate of the NMOS transistor is connected to a high voltage. The first resistance $R_1$ and the second resistance $R_2$, or both, may be adjusted so that there is no current going through the first switch $S_1$. Then the first switch $S_1$ is open and the second switch $S_2$ is closed, and the substitute voltage source replaces the Bandgap voltage reference to provide an output voltage of the power supply circuit.

In one embodiment, $V_{out}$ may be monitored to ensure it is within a range defined by the bottom threshold and the top threshold. If $V_{out}$ is larger than the top threshold, the gate of the PMOS transistor is connected to a high voltage, and the gate of the NMOS transistor is connected to a low voltage, so that the capacitance discharges to decrease $V_{out}$; when $V_{out}$ is less than the bottom threshold, the gate of the PMOS transistor is connected to a low voltage, and the gate of the NMOS transistor is connected to a high voltage, so that the capacitance is charged to increase $V_{out}$. This mechanism maintains $V_{out}$ in a range defined by the bottom threshold and the top threshold, and thus ensures a consistent power supply to external devices and reduces, if not eliminates, any device damage due to the fluctuation of power supply.

In one embodiment, an adjustment period for the voltages at the gates of the PMOS and NMOS transistors may be set (e.g., either by simulation or by actual measurements), then the voltages at the gates of the PMOS and NMOS transistors may be provided through pulse signals. In one embodiment, the pulse signals for the PMOS and NMOS transistors may come from one timing signal, the gate of one of the PMOS and NMOS transistors may be directly connected to the timing signal, and the gate of the other transistor may be connected to the timing signal through an inverter. In this embodiment, $V_{out}$ does not need to be constantly monitored, thus the computational burden and complexity of the circuit can be reduced.

In one embodiment, to compensate for the deviation of the output voltage due to accumulated error from the timing signal, the output voltage of the substitute voltage source may be re-calibrated with the output voltage of the Bandgap voltage reference after the substitute voltage source has been providing the output voltage for longer than a predetermined period of time, this mechanism further improves the accuracy and consistency of the output voltage.

Figure 5:
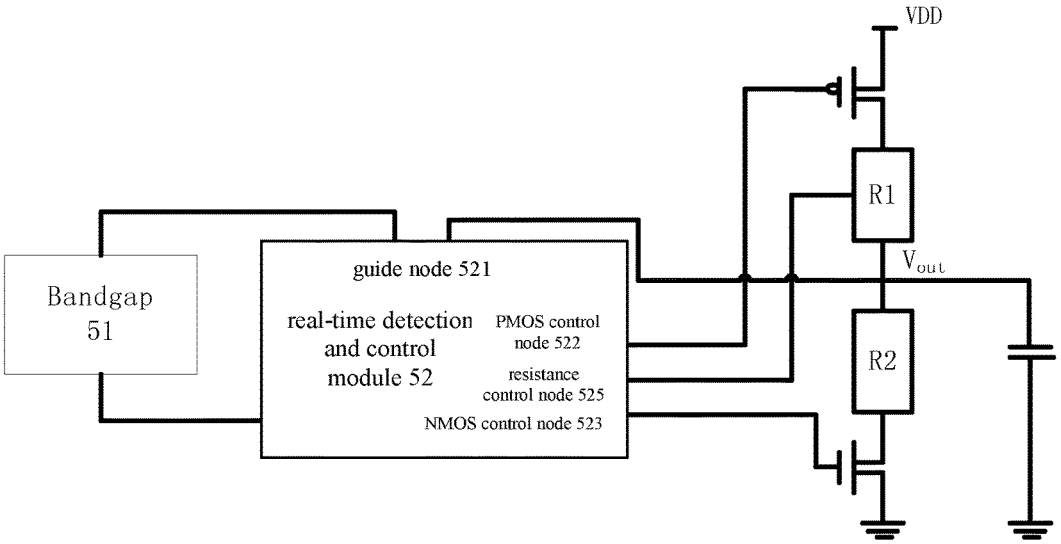
FIG. 5 shows a diagram illustrating a power supply circuit in accordance with a third embodiment of this inventive concept.

FIG. 5 shows a diagram illustrating a power supply circuit in accordance with a third embodiment of this inventive concept. Referring to FIG. 5, in this embodiment, an output node of the Bandgap voltage reference 51 may be connected to a guide node 521 of a real-time detection and control circuit 52. In one embodiment, a Bandgap control node of the real-time detection and control circuit 52 may be connected to a switch of the Bandgap voltage reference 51, so that the real-time detection and control circuit 52 may turn on or off the Bandgap voltage reference 51 through its Bandgap control node, and potential leakage loss of the Bandgap voltage reference 51 can be reduced.

An output node of a substitute voltage source is connected to the guide node 521 of the real-time detection and control circuit 52. During a $V_{out}$ calibration process, an output node of the Bandgap voltage reference 51 is connected to an output node of the substitute voltage source through the real-time detection and control circuit 52. These two output nodes are disconnected after the calibration process is completed.

In one embodiment, the guide node 521 of the real-time detection and control circuit 52 may comprise a resistance located between the output node of the Bandgap voltage reference 51 and the output node of the substitute voltage source. This resistance may protect the external devices from current surge as a result of large voltage difference between these two output nodes.

Referring to FIG. 5, a gate of a PMOS transistor in the substitute voltage source is connected to a PMOS control node 522 of the real-time detection and control circuit 52, a gate of the NMOS transistor in the substitute voltage source is connected to a NMOS control node 523 of the real-time detection and control circuit 52. A control node of an adjustable resistance ($R_1$ or $R_2$) may be connected to a resistance control node 525 of the real-time detection and control circuit 52. During $V_{out}$ calibration, the resistance control node 525 may adjust the adjustable resistance based on the current in the guide node 521 of the real-time detection and control circuit 52.

The real-time detection and control circuit 52 may monitor $V_{out}$, and maintain $V_{out}$ within a range defined by a bottom threshold and a top threshold by adjusting the voltages on the PMOS control node 522 and the NMOS control node 523.

Figure 6:
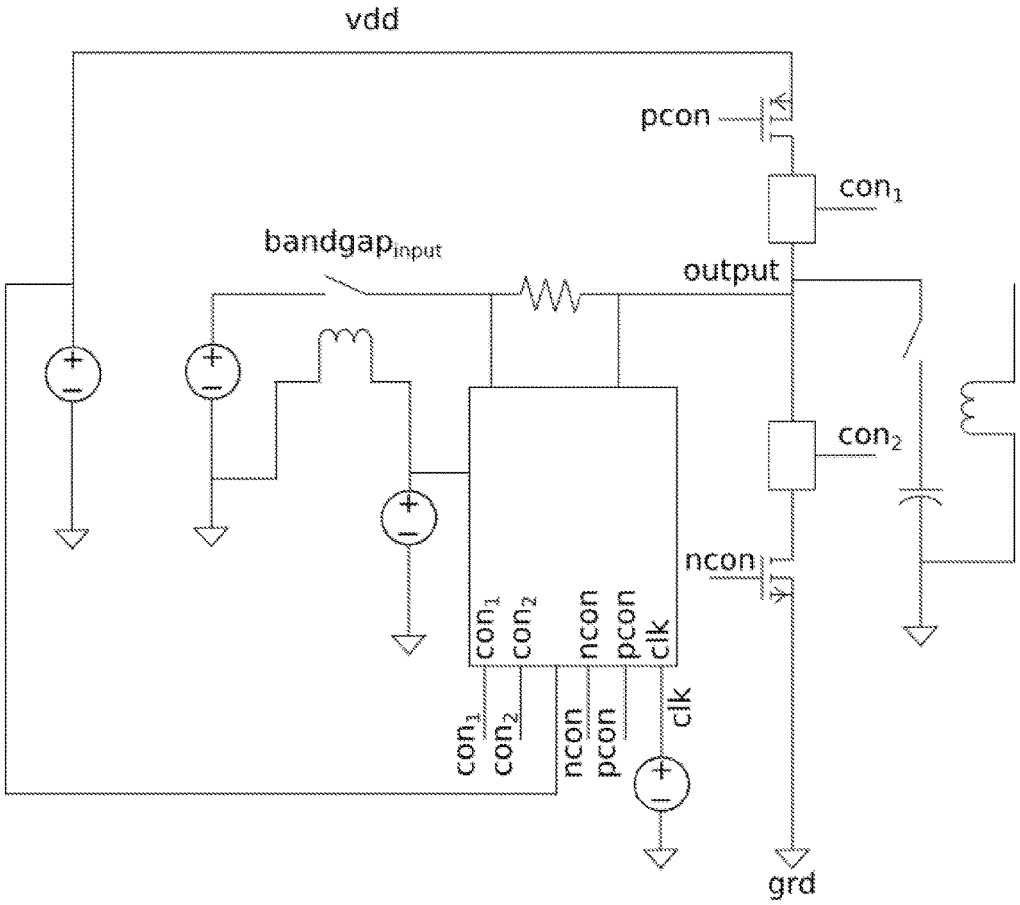
FIG. 6 shows a simulation diagram illustrating a power supply circuit in accordance with one embodiment of this inventive concept.

FIG. 6 shows a simulation diagram illustrating a power supply circuit in accordance with one embodiment of this inventive concept. In FIG. 6, $Bandgap_{input}$ is the output voltage of the Bandgap voltage reference, and output is the output voltage of the substitute voltage source, $con_1$ is a control signal connecting to a resistance in the PMOS transistor, $con_2$ is a control signal connecting to a resistance in the NMOS transistor, pcon is a gate control signal of the PMOS transistor, ncon is a gate control signal of the NMOS transistor, and clk is a timing control signal, with which the real-time detection and control circuit monitors the output voltage $V_{out}$.

Figure 7:
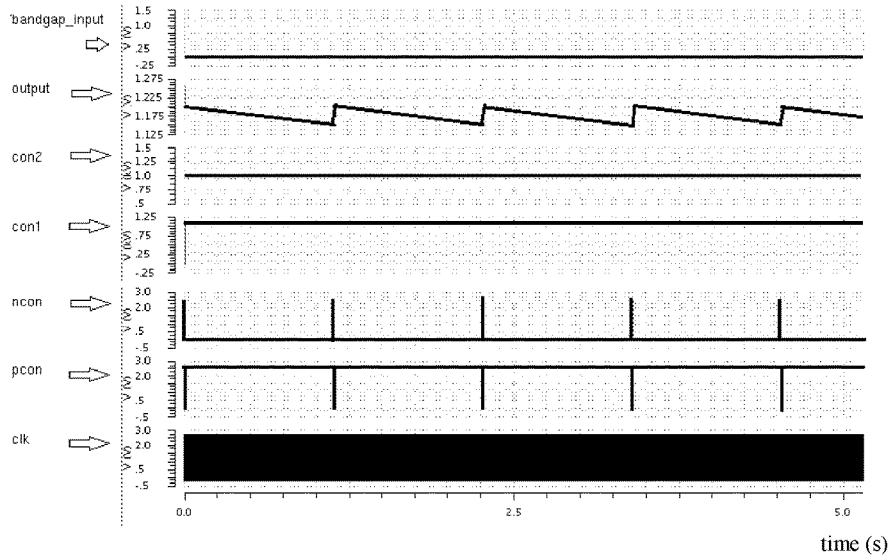
FIG. 7 shows a diagram illustrating the simulation result of the power supply circuit in FIG. 6.

FIG. 7 shows a diagram illustrating the simulation result of the power supply circuit in FIG. 6. As shown in FIG. 7, during the simulation, the output voltage of the substitute voltage source (output) remains in a certain range, it raises with the raise of impulse signals applied to the gates of the PMOS and NMOS transistors, and gradually decreases after that.

Figure 8:
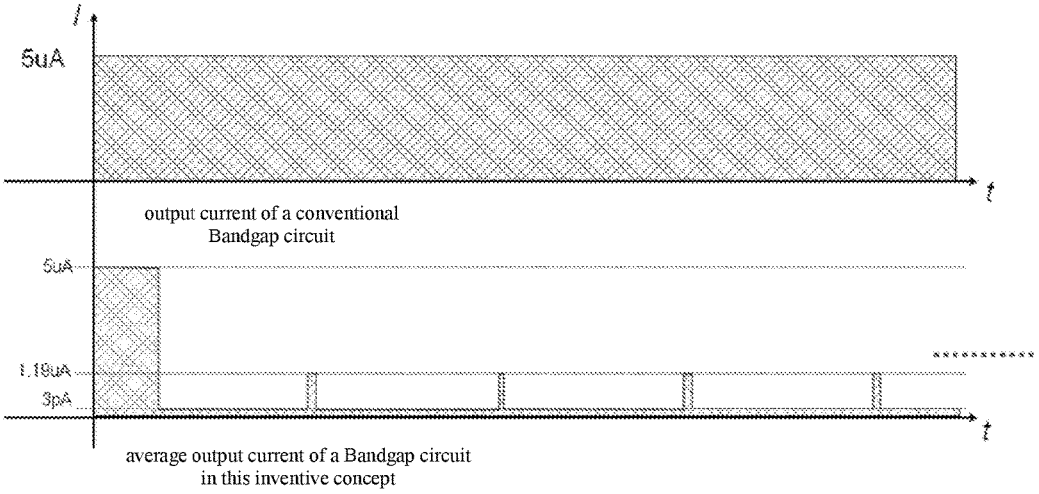
FIG. 8 shows a comparison of power consumption between a conventional circuit that uses a Bandgap voltage reference as a power supply and a power supply circuit in accordance with one embodiment of this inventive concept.

FIG. 8 shows a comparison of power consumption between a conventional circuit using a Bandgap voltage reference as a power supply and a power supply circuit in accordance with one embodiment of this inventive concept. As shown in FIG. 8, an output current of the Bandgap voltage reference in this inventive concept is substantially lower than that in conventional circuits. When the substitute voltage source provides an output voltage of the power supply circuit, the power consumption from the Bandgap voltage reference only comes from leakage current. The output current of the Bandgap voltage reference may be maintained at around 1 nA, which is substantially lower than that of conventional circuits. Thus, this inventive concept substantially reduces the power consumption of the Bankdgap voltage reference, and, as a result, prolongs its service life.

Figure 9:
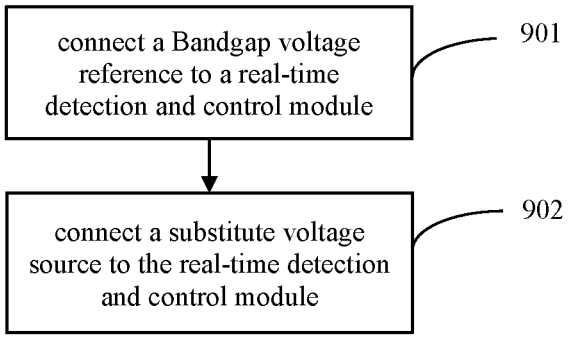
FIG. 9 shows a flowchart illustrating a method to form a power supply circuit in accordance with one embodiment of this inventive concept.

FIG. 9 shows a flowchart illustrating a method to form a power supply circuit in accordance with one embodiment of this inventive concept. Referring to FIG. 9, in step 901, a Bandgap voltage reference is connected to a real-time detection and control circuit. In step 902, a substitute voltage source is connected to the real-time detection and control circuit. The real-time detection and control circuit may adjust an output voltage of the substitute voltage source to match an output voltage of the Bandgap voltage reference. When these two output voltages are equal, an output voltage of the power supply circuit is provided by the substitute voltage source, and the Bandgap voltage reference may be turned off or disconnected from the circuit.

The power supply circuit formed in this method matches the output voltage of the substitute voltage source with the output voltage of the Bandgap voltage reference. When these two output voltages are matched, the output voltage of the power supply circuit is provided by the substitute voltage source, and the Bandgap voltage reference may be disconnected from the circuit. Therefore in this circuit, the power consumption of the Bandgap voltage reference may be reduced without affecting the stability of the output voltage.

In one embodiment, the substitute voltage source in this power supply circuit may be the same as that shown in FIG. 3, the process to form the substitute voltage source may comprise connecting a source of a PMOS transistor to a high voltage; connecting a drain of the PMOS transistor to a first node of a first resistance; connecting a source of a NMOS transistor to the ground; connecting a drain of the NMOS transistor to a second node of a second resistance; connecting a second node of the first resistance to a first node of the second resistance, wherein at least one of the first resistance and the second resistance is adjustable, and a control node of the adjustable resistance is connected to a resistance control node of the real-time detection and control circuit; and connecting a first node of a capacitance to the ground and connecting a second node of the capacitance to the first node of the second resistance.

An output voltage of the substitute voltage source may be adjusted (e.g., by adjusting the first resistance or the second resistance, or both) to match the output voltage of the Bandgap voltage reference. Therefore the substitute voltage source can provide the same output voltage a Bandgap voltage reference provides in conventional methods.

Figure 10:
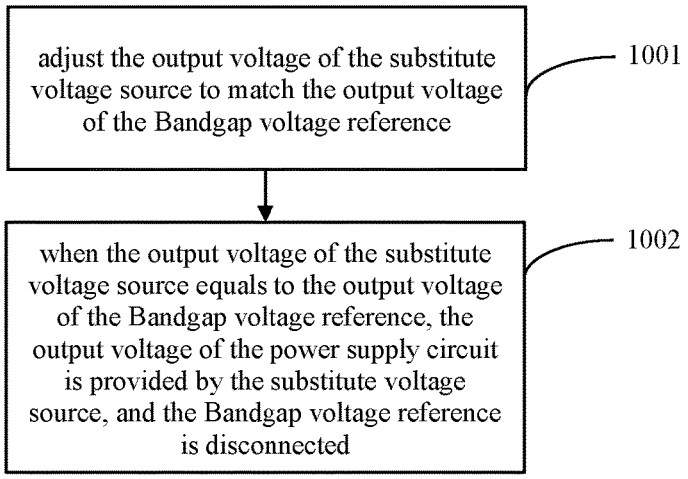
FIG. 10 shows a flowchart illustrating a control method for a power supply circuit in accordance with one embodiment of this inventive concept.

FIG. 10 shows a flowchart illustrating a control method for a power supply circuit in accordance with one embodiment of this inventive concept.

Referring to FIG. 10, in step 1001, an output voltage of a substitute voltage source is adjusted (e.g., by adjusting a resistance in the substitute voltage source) to match an output voltage of a Bandgap voltage reference.

In step 1002, when the output voltage of the substitute voltage source and the output voltage of the Bandgap voltage reference are equal, the output voltage of the power supply circuit is provided by the substitute voltage source, and the Bandgap voltage reference is disconnected.

In the control method described above, the output voltage of the substitute voltage source is first calibrated with the output voltage of the Bandgap voltage reference. After the calibration, the output voltage of the power supply circuit is provided by the substitute voltage source, and the Bandgap voltage reference may be disconnected. Hence, the power consumption of the Bandgap voltage reference may be reduced without affecting the stability of the output voltage.

In one embodiment, an output node of the Bandgap voltage reference may be connected to the output node of the substitute voltage source, and the voltage difference between these two output nodes may be measured by checking the current between them. The substitute voltage source may be adjusted (e.g., by adjusting a resistance in the substitute voltage source) until the current between these two output nodes is zero, which indicates matched voltages between these two output nodes. After that, the output voltage of the power supply circuit may be provided by the substitute voltage source, and the Bandgap voltage reference may be disconnected.

In the control method described above, by measuring the current between the output node of the substitute voltage source and the output node of the Bandgap voltage reference, the voltage difference between these two output nodes can be accurately measured, thus the output voltage of the substitute voltage source can closely match the output voltage of the Bandgap voltage reference. Therefore this power supply circuit can provide an accurate and consistent power supply to satisfy those devices that have strict requirements on power supply.

In one embodiment, the output voltage of the substitute voltage source may be constantly monitored to ensure its stability. For example, a bottom threshold and a top threshold may be set to define an acceptable range for the output voltage of the substitute voltage source. The substitute voltage source may be adjusted to decrease or increase its output voltage if it is larger than the top threshold or less than the bottom threshold. In one embodiment, the top threshold may be 1.2 V, and the bottom threshold may be 94% of the top threshold (i.e., around 1.13 V).

Figure 11:
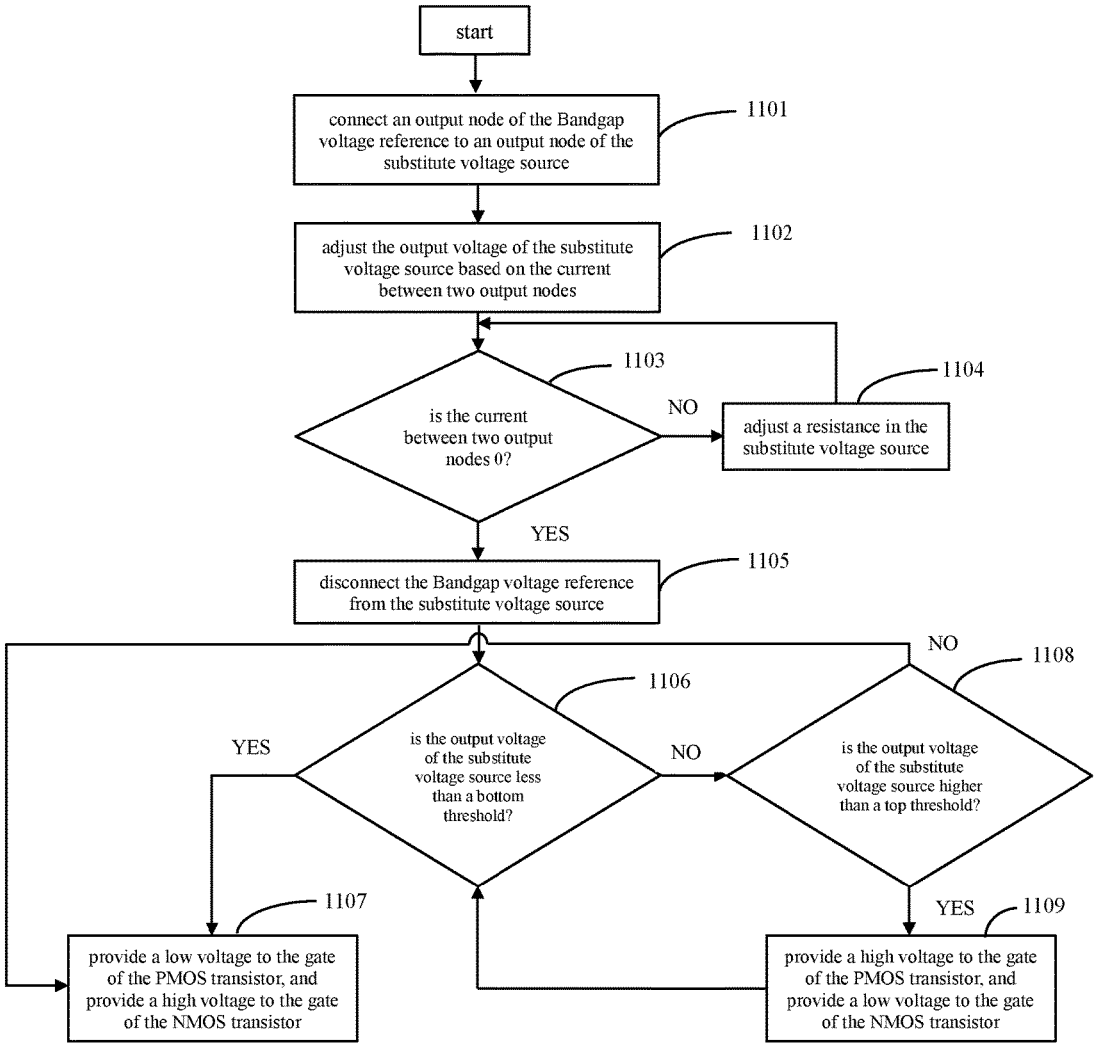
FIG. 11 shows a flowchart illustrating a second control method for a power supply circuit in accordance with one embodiment of this inventive concept.

In this embodiment, the power supply circuit constantly monitors and, if necessary, adjusts the output voltage of the substitute voltage source to ensure that it is within an acceptable range. FIG. 11 shows a flowchart illustrating a second control method for a power supply circuit in accordance with one embodiment of this inventive concept. Referring to FIG. 11, in step 1101, an output node of the Bandgap voltage reference is connected to an output node of the substitute voltage source.

In step 1102, by measuring the current between two output nodes, the output voltage of the substitute voltage source is adjusted to match the output voltage of the Bandgap voltage reference.

In step 1103, the current between the two output nodes is checked, if the current is zero, the process goes to step 1105, otherwise the process goes to step 1104.

In step 1104, a resistance in the substitute voltage source is adjusted to reduce the current between two output nodes.

In step 1105, the Bandgap voltage reference is disconnected from the power supply circuit, and a gate in a PMOS transistor in the substitute voltage source is connected to a low voltage, and a gate in a NMOS transistor in the substitute voltage source is connected to a high voltage.

In step 1106, the output voltage of the substitute voltage source is compared with a bottom threshold, if the output voltage is less than the bottom threshold, the process goes to step 1107, otherwise the process go to step 1108.

In step 1107, the gate of the PMOS transistor in the substitute voltage source is connected to a low voltage, the gate of the NMOS transistor in the substitute voltage source is connected to a high voltage, then the process returns back to step 1106.

In step 1108, the output voltage of the substitute voltage source is compared with a top threshold, if the output voltage is larger than the top threshold, the process goes to step 1109, otherwise the process returns to step 1106.

In step 1109, the gate of the PMOS transistor in the substitute voltage source is connected to the high voltage, and the gate of the NMOS transistor in the substitute voltage source is connected to the low voltage, and the process returns back to step 1106.

Through the control method described above, the output voltage of the substitute voltage source is monitored and maintained within a range defined by the bottom threshold and the top threshold. This ensures a consistent power supply to external devices and reduces, if not eliminates, any damage due to the fluctuation of power supply.

In one embodiment, the voltages at the gates of the PMOS and NMOS transistors may be periodically changed, the period of the voltage change may be determined either by simulation or by actual measurements. After the period of the voltage change is determined, the voltages at the gates of the PMOS and NMOS transistors may be provided through pulse signals. In one embodiment, the pulse signals may come from one timing signal, with the gate of one of the PMOS and NMOS transistors directly connected to the timing signal, and the gate of the other transistor connected to the timing signal through an inverter. In this embodiment, the output voltage of the substitute voltage source ($V_{out}$) does not need to be constantly monitored, thus the computational burden and complexity if the circuit can be reduced.

In one embodiment, to compensate for the deviation of the output voltage due to accumulated error from the timing signal, the output voltage of the substitute voltage source may be re-calibrated with the output voltage of the Bandgap voltage reference if the substitute voltage source has been providing the voltage output for longer than a predetermined period of time, this mechanism further improves the accuracy and consistency of the output voltage.

This concludes the description of a power supply circuit, its generating and control methods in accordance with one or more embodiments of this inventive concept. For the purpose of conciseness and convenience, some components or procedures that are well known to one of ordinary skill in the art in this field are omitted. These omissions, however, do not prevent one of ordinary skill in the art in this field to make and use the inventive concept herein disclosed.

While this inventive concept has been described in terms of several embodiments, there are alterations, permutations, and equivalents, which fall within the scope of this disclosure. It shall also be noted that there are alternative ways of implementing the methods and apparatuses of the inventive concept. Furthermore, embodiments may find utility in other applications. It is therefore intended that the claims be interpreted as including all such alterations, permutations, and equivalents. The abstract section is provided herein for convenience and, due to word count limitation, is accordingly written for reading convenience and shall not be employed to limit the scope of the claims.

What is claimed is:

1. A power supply circuit, comprising:

a Bandgap voltage reference;

a real-time detection and control circuit; and a substitute voltage source, wherein the real-time detection and control circuit is connected to the substitute voltage source and the Bandgap voltage reference, wherein the real-time detection and control circuit is configured to adjust an output voltage of the substitute voltage source based on a current between an output node of the substitute voltage source and an output node of the Bandgap voltage reference, wherein the output node of the Bandgap voltage reference is disconnected from the output node of the substitute voltage source when the current is zero, and wherein the output node of the Bandgap voltage reference is connected to the output node of the substitute voltage source before the current is determined to be zero.

2. The circuit of claim 1, wherein the power supply circuit is configured to provide the output voltage of the substitute voltage source after the output voltage of the substitute voltage source has been adjusted.

3. The circuit of claim 2, wherein the substitute voltage source comprises:

a P-type Metal-Oxide-Semiconductor (PMOS) transistor;

an N-type Metal-Oxide-Semiconductor (NMOS) transistor;

a first resistance;

a second resistance; and a capacitance, wherein a gate of the PMOS transistor is connected to a PMOS control node of the real-time detection and control circuit, a source of the PMOS transistor is connected to an input high voltage, and a drain of the PMOS transistor is connected to a first node of the first resistance, wherein a gate of the NMOS transistor is connected to a NMOS control node of the real-time detection and control circuit, a source of the NMOS transistor is connected to the ground, and a drain of the NMOS transistor is connected to a second node of the second resistance, wherein a second node of the first resistance is connected to a first node of the second resistance, at least one of the first resistance and the second resistance is adjustable, and a control node of the resistance that is adjustable is connected to a resistance control node of the real-time detection and control circuit, wherein a first node of the capacitance is connected to the ground, and a second node of the capacitance is connected to the first node of the second resistance, and wherein either the second node of the first resistance or the first node of the second resistance, or both, is the output node of the substitute voltage source.

4. The circuit of claim 3, wherein adjusting the output voltage of the substitute voltage source based on a current between the output node of the substitute voltage source and the output node of the Bandgap voltage reference comprises:

the real-time detection and control circuit adjusting the adjustable resistance, so that a current between the output node of the substitute voltage source and an output node of the Bandgap voltage reference is zero, wherein the output node of the Bandgap voltage reference is connected to the output node of the substitute voltage source.

5. The circuit of claim 4, wherein when the real-time detection and control circuit adjusts the resistance that is adjustable, the real-time detection and control circuit provides a low voltage to the gate of the PMOS transistor, and a high voltage to the gate of the NMOS transistor.

6. The circuit of claim 3, further comprising:

the real-time detection and control circuit monitoring the output voltage of the substitute voltage source when the substitute voltage source provides the output voltage of the power supply circuit; and providing a low voltage to the gate of the PMOS transistor, and a high voltage to the gate of the NMOS transistor when the output voltage of the substitute voltage source is lower than a bottom threshold, and providing the high voltage to the gate of the PMOS transistor, and the low voltage to the gate of the NMOS transistor when the output voltage of the substitute voltage source is higher than a top threshold.

7. The circuit of claim 3, further comprising:

the real-time detection and control circuit, through a predetermined pulse signal, providing control voltages to the gate of the PMOS transistor and the gate of the NMOS transistor when the substitute voltage source provides the output voltage of the power supply circuit, wherein the control voltage provided to the gate of the PMOS transistor is opposite to the control voltage provided to the gate of the NMOS transistor.

8. The circuit of claim 1, further comprising:

the real-time detection and control circuit monitoring the output voltage of the substitute voltage source when the substitute voltage source provides the output voltage of the power supply circuit; and increasing the output voltage of the substitute voltage source if it is lower than a bottom threshold, and lowering the output voltage of the substitute voltage source if it is higher than a top threshold.

9. The circuit of claim 1, further comprising:

after the substitute voltage source had been providing the output voltage of the power supply circuit for longer than a predetermined period of time, the real-time detection and control circuit adjusting the output voltage of the substitute voltage source to match the output voltage of the Bandgap voltage reference.

10. A method for forming a power supply circuit, the method comprising:

connecting a Bandgap voltage reference to a real-time detection and control circuit; and connecting a substitute voltage source to the real-time detection and control circuit, wherein the substitute voltage source provides comprises:

a first resistor;

a second resistor, wherein the first resistor and the second resistor include an adjustable resistor, and wherein a control node of the adjustable resistor is electrically connected to a resistance control node of the real-time detection and control circuit;

an output node electrically connected between the first resistor and the second resistor; and a capacitor comprising a first terminal and a second terminal, wherein the first terminal is electrically connected to the ground, and wherein the second terminal is electrically connected through the output node to the first resistor and is electrically connected through the output node to the second resistor.

11. The method of claim 10, wherein the substitute voltage source further comprises:

a PMOS transistor, wherein a source of the PMOS transistor is electrically connected to an input high voltage, and wherein a drain of the PMOS transistor is electrically connected to the first resistor; and an NMOS transistor, wherein a source of the NMOS transistor is electrically connected to the ground, and wherein a drain of the NMOS transistor is electrically connected to the second resistor.

12. The method of claim 11, further comprising:

connecting a gate of the PMOS transistor to a PMOS control node of the real-time detection and control circuit; and connecting a gate of the NMOS transistor to a NMOS control node of the real-time detection and control circuit.

13. The method of claim 11, further comprising one of the following two procedures:

connecting the gate of the PMOS transistor to a pulse control node of the real-time detection and control circuit; and connecting the gate of the NMOS transistor, through an inverter, to the pulse control node of the real-time detection and control circuit; or connecting the gate of the NMOS transistor to a pulse control node of the real-time detection and control circuit; and connecting the gate of the PMOS transistor, through an inverter, to the pulse control node of the real-time detection and control circuit.

14. A control method for a power supply circuit, the method comprising:

adjusting an output voltage of a substitute voltage source based a current between an output node of the substitute voltage source and an output node of a Bandgap voltage reference; and disconnecting the output node of the Bandgap voltage reference from the output node of the substitute voltage source when the current is zero, wherein the output node of the Bandgap voltage reference is connected to the output node of the substitute voltage source before the current is determined to be zero.

15. The method of claim 14, further comprising: outputting the output voltage of a substitute voltage source from the power supply circuit after the output voltage of the substitute voltage source has been adjusted.

16. The method of claim 14, further comprising:

monitoring the output voltage of the substitute voltage source when the substitute voltage source provides the output voltage of the power supply circuit; and increasing the output voltage of the substitute voltage source if it is lower than a bottom threshold, and decreasing the output voltage of the substitute voltage source if it is higher than a top threshold.

17. The method of claim 15, wherein adjusting the output voltage of the substitute voltage source based on a current between the output node of the Bandgap voltage reference and the output node of the substitute voltage source comprises:

providing a low voltage to a gate of a PMOS transistor in the substitute voltage source, and providing a high voltage to a gate of a NMOS transistor in the substitute voltage source;

adjusting a resistance in the substitute voltage source until the current between the output node of the Bandgap voltage reference and the output node of the substitute voltage source is zero, wherein the output node of the Bandgap voltage reference is connected to the output node of the substitute voltage source, wherein the substitute voltage source comprises:

the PMOS transistor;

the NMOS transistor;

a first resistance;

a second resistance; and a capacitance, wherein a source of the PMOS transistor is connected to an input high voltage, a drain of the PMOS transistor is connected to a first node of the first resistance, a source of the NMOS transistor is connected to the ground, a drain of the NMOS transistor is connected to a second node of the second resistance, a second node of the first resistance is connected to a first node of the second resistance, wherein at least one of the first resistance and the second resistance is adjustable, a first node of the capacitance is connected to the ground, and a second node of the capacitance is connected to the first node of the second resistance, and either the second node of the first resistance or the first node of the second resistance, or both, is the output node of the substitute voltage source.

18. The method of claim 17, further comprising:

when the output voltage of the substitute voltage source is lower than a bottom threshold, providing the low voltage to the gate of the PMOS transistor, and providing the high voltage to the gate of the NMOS transistor; and when the output voltage of the substitute voltage source is higher than a top threshold, providing the high voltage to the gate of the PMOS transistor, and providing the low voltage to the gate of the NMOS transistor.

19. The method of claim 17, further comprising:

providing control voltages to the gate of the PMOS transistor and the gate of the NMOS transistor through a predetermined pulse signal when the substitute voltage source provides the output voltage of the power supply circuit, wherein the control voltage provided to the gate of the PMOS transistor is opposite to the control voltage provided to the gate of the NMOS transistor.

20. The method of claim 14, further comprising:

after the substitute voltage source has been providing the output voltage of the power supply circuit for longer than a predetermined period of time, adjusting the output voltage of the substitute voltage source to match the output voltage of the Bandgap voltage reference.

* * * * *